US009687993B2

(12) United States Patent
Lopez Perez

(10) Patent No.: US 9,687,993 B2
(45) Date of Patent: Jun. 27, 2017

(54) UNIVERSAL PERFORATION SYSTEM FOR INSTALLATION ON A BINDING OR SPIRAL-BINDING MACHINE CAPABLE OF BINDING USING ANY BINDING SYSTEM

(71) Applicant: Emilio Carlos Lopez Perez, Distrito Federal (MX)

(72) Inventor: Emilio Carlos Lopez Perez, Distrito Federal (MX)

( * ) Notice: Subject to any disclaimer, the term of this patent is extended or adjusted under 35 U.S.C. 154(b) by 416 days.

(21) Appl. No.: 14/273,599

(22) Filed: May 9, 2014

(65) Prior Publication Data

US 2015/0321373 A1 Nov. 12, 2015

(30) Foreign Application Priority Data

Mar. 24, 2014 (MX) ..... MX/a/2014/003559

(51) Int. Cl.

| | |
|---|---|
| ***B26D 5/16*** | (2006.01) |
| ***B26F 1/02*** | (2006.01) |
| ***B26D 5/10*** | (2006.01) |
| ***B42B 5/12*** | (2006.01) |

(52) U.S. Cl.

CPC ..... *B26F 1/02* (2013.01); *B26D 5/10* (2013.01); *B26D 5/16* (2013.01); *B42B 5/12* (2013.01); *B42B 5/123* (2013.01)

(58) Field of Classification Search

CPC .. B42B 5/12; B42B 5/123; B26F 1/14; B26D 5/10; B26D 5/16

USPC ..... 83/167, 549, 618, 620, 622, 629, 687, 83/691, 133; 402/1, 79; 412/16, 39–40

See application file for complete search history.

(56) References Cited

U.S. PATENT DOCUMENTS 7,628,103 B2 * 12/2009 Lemens ..... B26D 7/1863 83/123

2008/0107500 A1 * 5/2008 Cheng ..... B26F 1/02 412/16

* cited by examiner

*Primary Examiner* — Ghassem Alie

*Assistant Examiner* — Nhat Chieu Do

(74) *Attorney, Agent, or Firm* — Defillo & Associates; Evelyn A. Defillo

(57) ABSTRACT

Relates to an improved universal industrial product to be installed on an existing binding or spiral binding machine, capable of binding in all existing binding systems that allow to perform a single set of oblong perforations, according to the paper size, and in which the support or receive the rings, spirals, or combs and binder having multiple size rings, which are currently formed by using machines with different perforation steps. Includes perforation dies having an oblong shape.

4 Claims, 10 Drawing Sheets

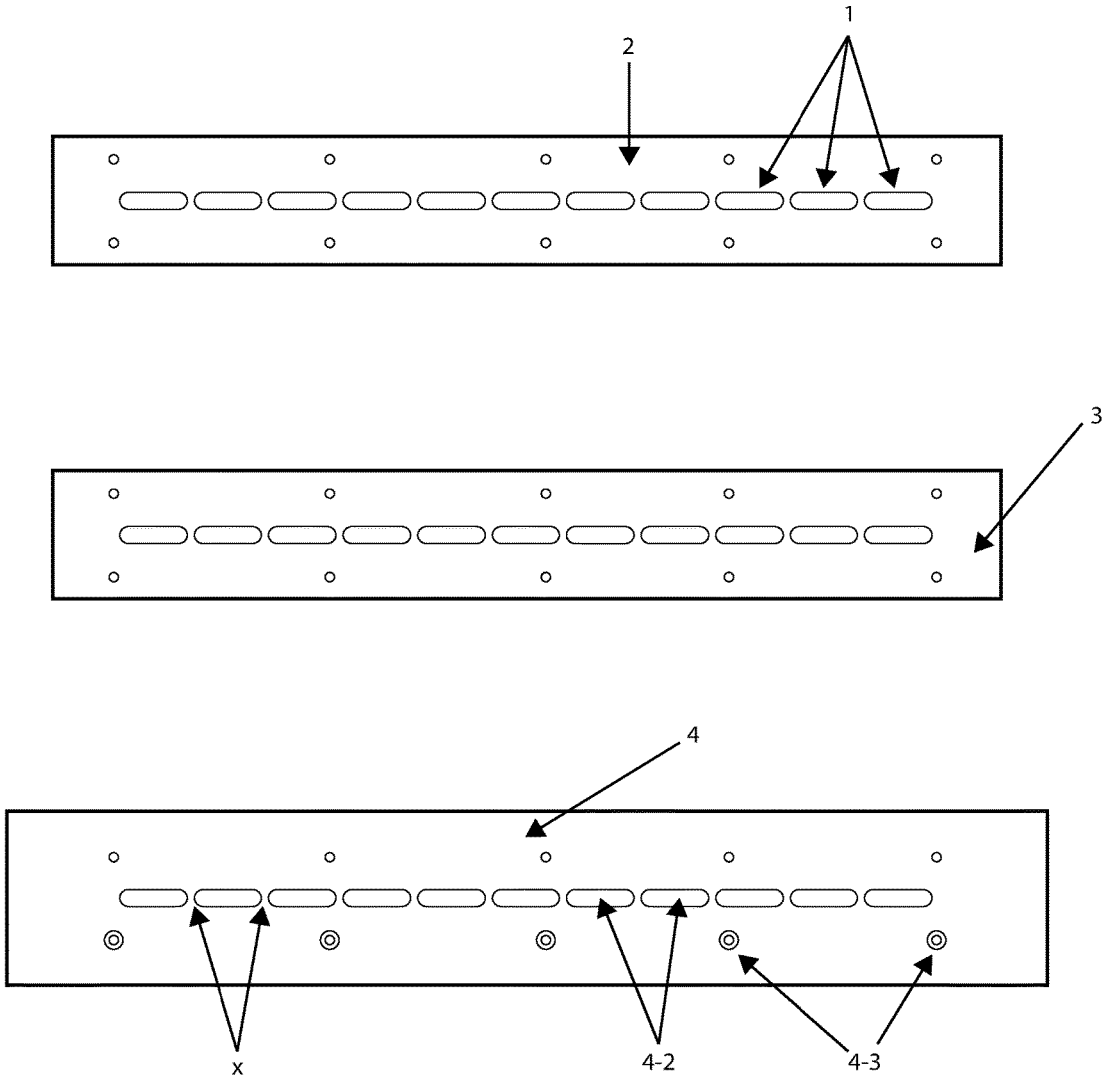
FIG. 2-A

UNIVERSAL PERFORATION SYSTEM FOR INSTALLATION ON A BINDING OR SPIRAL-BINDING MACHINE CAPABLE OF BINDING USING ANY BINDING SYSTEM

FIELD OF THE INVENTION

The present invention generally relates to a new binding or spiral binding system and more particularly to improvements to the universal binding system that allows having different binding systems with different perforations included by existing systems of different binding.

BACKGROUND OF THE INVENTION

The known document binding systems have more than 50 years with the same perforation formats that are round, square, rectangular, and oval, without having substantial changes. This has forced the market in the necessity of having equipment for each type of required binding, since consumers both in Mexico and the rest of the world require several different types of equipment to meet their needs or the needs of their customers.

Among the known binding systems can be cited the spiral binding machines with: double loop wires (3:1 and 2:1 pitch) metal coil I (3:1, 4:1, 5:1, 0.2475, 6 mm pitch), and plastic coil (3:1, 4:1, 5:1, 0.2475", 6 mm pitch), and the plastic combs of 6 and 11 tips which are on the market, as well as punches of 2, 3, 4 or multiple perforations for folders or binders of different formats. For years consumers of these types of products have increased considerably and they are looking to do more with less and the present system summarized the market's request. All these aforementioned binding systems are unified into a single universal system with the present technical proposal.

In the MX 918 registration issued Aug. 16, 2001, is claimed a spiral binding machine formed by a punch and a closing for spiral binding with a double loop wire, which comprises a punching bar having two bars, one with equidistant spaced perforations that receive a series of punches and the other bar of the two bars covers it, and a closing device formed by a closing bar, an actuating lever of both mechanisms, a punch train, a ring holder arranged in the front part of a support platform (page 24).

The MX 978 registration discloses that a perforation bar which comprises a platform which includes towards the rear section an upper transversal tapper, where is firmly fixed a bar having an inverted channel shape that linearly presents a series of holes equidistant to each other; over this bar is arranged in a fixed manner a base bar also perforated (page 8 lines 9 to 14).

The MX 1017 registration discloses a spiral binding machine for paper sheets that allows to quickly and efficiently thread perforated sheets into a double loop wire of suitable measuring and closing the ring, a plastic spiral, metallic, or a plastic comb may be used, (page 5, 16-20).

The MX 1398 registration, discloses a machine with an option of two different perforation diameters, without removing punches like in other machines, including an electric heater for thermal plaster. For more information, it is suggested to consult these prior art documents, whose technique has been developed by the present inventor.

Finally, the Mexican patent 275,441 discloses a binding machine with perforations for two different perforation measurements, page 25.

All of the previous technology can be overcome by the new machine of the present invention, which replaces the different machines used to perform various different binding.

The present patent application provides, by way of new industrial product, a binding system which by itself makes the work carried out by other systems of this type, in binding systems with different perforations. Obviously, this represents a substantial savings in a plurality of existing machines, representing also saving spaces for these machines, which is of great importance in homes, private offices, government offices, centers of copied, printers and stationers primarily.

Here it is worth mentioning that improvements proposed in this application to a universal binding system to install on a binding or spiral binding conventional binding machine, able to bind in all existing binding systems, has as a basis the PCT patent application No. MX/2011/000135 submitted to IMPI by the inventor of this application, dated Nov. 9, 2011, as well as this document.

The inventor of the present application, presented on Nov. 9, 2011, the request PCT-MX-000135 the Patent Cooperation Treaty, of the World Intellectual Property Organization. In the International Search Report, three references were cited as anticipation, of which the present inventor presents the following observations and objections:

WO 2005115764 A2 (Esselte et al.) Aug. 12, 2005

Paragraphs 00144 to 00148: indicates that it is a machine that makes perforations for certain amounts of paper (at least 2 sheets) for the placement of a plastic comb.

In the same way indicates that the particular paper formats that accepts this machine and how to orient the paper in the machine.

It also discloses the shape of the perforation which makes this machine in the form of a "C".

In the above mentioned paragraphs, it compared a system that has 40 years on the market with one of total innovation in the industry, because the 19 perforations used by the old system are oval in shape with the straight or rounded corners with measures of 8×3 mm each.

In the universal system, the 11 perforations are oblong and not oval, and are 22 mm×4.5 mm, number and dimensions that make it completely different, because of the technical effects obtained by the universal system.

While it is true that the binding principle is the same, meaning by a device connecting sheets of paper, the processes and ways of doing so are totally different.

In particular the universal system serves in an inclusive way, unique, with a single set of 11 oval perforations for 10 different existing perforation pitchs, in different sheet dimensions and different binding formats and the one on the first reference only serves for a machine that has a single perforation step.

Paragraphs 00181 to 00184: These paragraphs only disclose the operation which makes the equipment cited by this patent and discloses rectangular, circular, trapezoidal shaped perforations.

Nowhere is disclosed an oblong perforation or a set of them, and this is the central basis of the patent registration that is being requested.

Also, discloses of the hardening of the perforator punches, but in all cases it is not talking about a system, these paragraphs disclose how to manufacture a particular machine.

The present invention does not refer to a single machine, but refers to a universal perforation system, never citing an existing one.

Paragraphs 0236 to 00252: these show the ways in which the machine needs to be operated and its uses, but at no time refers to a system such as that we are presenting.

In all of the paragraphs it is mentioned the operation and forms of use of the machine only.

The figures in this document are very illustrative and all show that this machine is completely different from the universal system in the above-mentioned PCT.

US 2008/0107500 A1 (Cheng et al.) Aug. 5, 2008.

Paragraphs 0017 to 0032: discloses a machine, not a perforation system with 3 different trays for each perforation step. They disclose the parts of the machine, lever, base, cover, etc, but this does not interfere at any time with the present invention since they are common elements to all machines. On the other hand, the present system presents an indissoluble unity between the shape and size of the individual perforations and/or the produced set of all of them and the fact to serve for all type and measures of perforations and perforation sets of the existent machines, as well as of the different binding procedures based on rings, combs, etc. We are talking about a universal system that comprises all existing binding procedures and is useful for all types of existing machines in them.

It is disclosed the formation of the machine and that in the first perforation module the perforations are rectangular, in the second it indicates that the perforations are of another step and rounded as well as in the third perforations row.

Once more, it only indicates the way in which the machine is built and the three different steps it has, but does not have any similarity to the universal system nor to the oblong perforations of the system, nor to the number of perforations that includes, nor to the technical machine effects, nor to the degree of applicability of the universal system, which does not have anything to do with the indication of the written opinion.

The figures of this document, as well as the previous one, are very illustrative and all is disclosed is that this machine is completely different from the universal system in the above-mentioned PCT.

GB 2412891 (Primax Electronics Ltd) Dec. 10, 2005

Page 1: basically refers to the functionality and usefulness of a binding. And in addition to how a sheet of paper is perforated with punch in sectioned modules.

It does not refer to the PCT in question, other than mentioning the words "hole punch" and how it works, the cut made by a perforation punch for binding.

Page 3-7: refers to perforation blocks that slide to activate the operation procedure, as in the previous documents, but does not make reference to the oblong perforations, nor to the system that we are referring in the PCT.

All the above refer to perforation procedures and binding called "Cerlox" or "plastic comb", but nothing more, never referred to any innovation, what is patented is the ways in which the machines are designed, but never indicated anything about the shape of the perforations or a set of perforations, nor any similarity of technical effects or results as those obtained with the universal system.

Illustrative figures indicates that in this machine the perforation is round, and not oblong as in the PCT to which we refer and also indicates the patent of a machine, but not of a universal perforation system.

In the opinion written with respect to the claims:

Claim 1

Even though Claim 1 indicates a perforation and that as such a perforation would not have novelty, it is also true that there are not any perforations having an oblong shape, with this perforation pitch of perforation and its universal utility for all binding systems, so it has novelty and inventive step, since it makes it unique.

There is NOVELTY, since although it is similar to other perforation systems and spiral binding systems, the universal system of the present invention, by understanding, encompassing, and including all of the perforation pitchs but without losing the EQUIDISTANT distances and measures that are currently used (and therefore of binding) in a perforation (and a symmetrical set of perforations (11)), single oblong perforation more elongated than broad and rounded borders of the edges, resulting in a versatility that includes all the punch pitchs and binding of all existing similar systems. THERE IS NOTHING SIMILAR IN THE KNOWN ART.

There is INVENTIVE. This is supported in the same statement of claim 1 that the invention "includes all the pitchs of perforation but without losing the EQUIDISTANT distances and measures that are currently used". For these demonstrable results, the inventor developed his own sophisticated metrological system and carried out a series of experimental development and testing with models that led him to obtain such result of the universal application, result included in the above disclosure, same which has a scientific base and practical application defined a technical effect and tangible products of vast economic utility.

In the industry there is nothing of this kind and industry experts that explained the system after 9 Nov. 2011, legal date of the PCT/MX 2011/000135, were surprised by the simplicity and the innovation of the system (see the principle of Ockham's razor), the versatility and the universal application thereof, by which, because it is simple doesn't mean that it is not inventive. It is inventive, since there isn't anything in this category on the market.

Claim 2

Regarding Claim 2, the written opinion indicates that it has novelty, industrial applicability, but which does not have inventive activity, but it does, since the matrix, platforms and punches can be installed in any type of machine directly for this type of work, regardless of whether or not they are industrial, so it has inventive activity, even on modern electric or automated machines because of the technical effects produced by the art of the present invention.

The cited documents by the written opinion do not have anything to do, therefore the fact that the manufacture of a binding machine is similar with another of different origin has nothing to do with that which relates it to this PCT. What promotes the PCT is a system, not a machine, the 3 documents cited as a reference do not give the category of inventive activity: are patents for machines that use a very old system, but patents are for machines, and not a new system as is the case, based on devices that can remotely be similar, but featuring innovative industrial results and technical effects of universal application different to all procedures of existing machines.

We are disclosing about a system, not a machine, the comparisons that are made in the written opinion, cannot be taken as if they deducted inventive activity because up to the presentation of this PCT, there was nothing the same, for which is novel, and it has novelty.

It is important to note that what is being patented is a system (not a machine) completely innovative that does not exist anywhere in the world and who emerges as a distinct concept as how to bind, even though it is true that all existing binding systems may seem equal (that are not) they have their own characteristics that make them different from each other.

This system in particular may do with a single perforation what is done by each one of the existing devices, this means that it is totally inventive. It does do bindings but it makes them as no other system. It can be compared as when it was invented for the first time the "autostick" in the automobile industry, the market might think it was a hybrid car between automatic and manual, the truth is that no one had invented a driving system which could instantly change from automatic to manual without having the necessity of stepping on a clutch. This "autostick" system today exists in many brand name cars, since it is something that can be implemented in any car.

In the same way, this binding system can be incorporated to any machine binding machine regardless of whether it is manual or automatic, because the manufacturer purchased the license to use, or, the license for the manufacture, may be able to develop this innovative concept in their own machines, in the same way that Chrysler sells the license of "autostick" to other automobile brands on the market.

At the time of changing the wording in the PCT, we believe is of some importance to highlight that the system uses and has perforations which until today nobody has developed or used in the industry, and that the cited references in the written opinion are machines with systems that have more than 40 years of existence on the market, none as to the UNIVERSAL system of oblong perforations, and cited patents of machines, not systems or the concepts which do not exist in the current market.

Claim 4

In the case of this claim, cited parameters in terms of the characteristics and dimensions of the first and the second platforms justify the inventive pitch and the objective of the invention, which is an innovation in the state of the art and implicitly involves an inventive pitch and novelty, since to obtain these results, the inventor developed his own sophisticated metrological system and held a series of studies and experimental developments, and tests with models, which led him to obtain such result of the universal application, result includes in the limitations cited in claim 1, which defines the system of the present invention, which has a scientific basis and practical application defined in a technical effect and tangible products of a vast economic utility.

Technically, this proposal is based on a principle of including all the perforation pitches with an oblong perforation (longer than wide, with rounded ends) but without losing the distances and measures which are at the present those that use the existing binding machines. This is accomplished through the use of a system of relative spatial reference between pitches of perforation-mediums binding, with base on binding mediums of all dimensions, sizes, and types, resulting in dynamic connection of calibrated physical media of support, guidance, and perforation arranged between them, arranged according to a three-dimensional development sub-system, in accordance with the dimensions of sheets to be perforated and binding, capable of producing all the existing perforation pitchs and sheet binding, in a single set of oblong perforations; perforations produced in the set of aligned stacked sheets that are able to accommodate any type of ring or binding medium of any dimension and type, in accordance with all existing perforation pitchs for sheets, as well as of the different sizes and formats of binding, already described in the now national phase of the above mentioned system.

In accordance with the above, only with the attainment of the set of oblong perforations produced by the application of the improved system of the present invention, there is no need to change any of the components that are today produced in Mexico and other countries of the world and that the customer's investment would be represented by the purchase of a single equipment.

The assumption of the technical proposal is to unite in oblong perforations and thus replace the multiple number of perforations that each perforation pitch currently requires with each punching and binding system.

As it is easily understandable, is overcome with only one improved machine, the problem of perforating formats that affect different forms: round, square, rectangular and oval, i.e. that it is not forced to have an equipment for each type of required binding system, since to date, the consumers both in Mexico and the rest of the world required various equipment to meet their needs or those of their final customers.

With the present invention is achieved a universal perforation system and improved binding with a single machine, which until now had only been a hypothesis for many years for manufacturers around the world, removing the principal limitations that have been the production costs in each system, associated with the construction of different types of machines and binding operations; for example, in Mexico oval perforation is not used for spiral, since it is much more expensive than the round one, at the same time that unifying the way to use metallic or plastic spirals using different pitchs.

The improvement comprises that to the first oblong matrix subsystem already described, is installed a perforation selector mechanism, including calibrated integrated mechanical mediums of support, guide, perforation, and binding; interrelated parametrically among themselves; and device including an oblong matrix formed with the dynamic coupling of three elongated rectangular platforms and a perforation pattern selector mechanisms, in which the first platform is a platform that carries male punches, a second platform of the same dimensions of the first, which serves as a guide to the male punches, and a third support platform larger than the previous platforms, which works as a female blade and which is equipped with a row of hollow punches of oblong configuration, components all positioned synchronously aligned to the positions of the male punches of the first row platform that carries punches and with the spaces of the second platform guide punches or comb and with the positions of the perforation selector mechanism; all this makes it possible to that the established correlations allow to scale the symmetry in the spatial disposition of the oblong perforations produced, in accordance with the measures of the paper sheets to be perforated. The formation of equidistant spaces throughout the oblong perforations produced in sheets of different sizes and in different binding formats, is obtained with the help of the synchronized link and aligning of a perforation pattern selector mechanism, which applied synchronous patterns of proportional perforation positioning, according to the dimensions and formats of sheets and the type of binding and that allows to block or selectively open the perforation positions to apply different formats of perforation-binding.

OBJECTIVES OF THE INVENTION

The main objective of the present invention is to provide improvements to a universal perforation system to install on an existing conventional binding or spiral binding machine, able to bind in all existing systems of binding.

It is another objective of the present invention to provide improvements to a universal perforation system to install on an existent conventional binding or spiral binding, able to bind to all existing binding systems but without losing the distances and measures currently using the various systems in use of perforation and binding and that is able to unite in oblong perforations and thus replace the multiple number of perforations that each perforation pitch currently requires with each perforation and binding system, according to the different dimensions of sheets and binding formats.

Another objective of the present invention is to provide improvements to a universal perforation system to install on an existing conventional binding or spiral binding machine, able to bind in all existing binding systems and that the subsystem of the present invention can be used to perforate larger papers sizes, running or expanding the subsystem in long or short legal size: size A4, size A3, size A2, using the connection to the perforation selector mechanism.

Still another objective of the universal perforation system of the present invention is to provide improvements to a single set of oblong perforations that are able to accommodate any type of loop wire or existing system of spiral binding of any dimensions and types, in accordance with all existing perforation pitch used in the various systems in use, and in accordance with the different dimensions of the sheets to perforate and binding, as well as of the different sizes and binding formats.

BRIEF DESCRIPTION OF THE DRAWINGS

For a better understanding of the present invention, this is described based on a preferred modality illustrated in figures that accompany this description and where:

FIG. 2A is a side exploded view of the three platforms horizontally shifted and aligned of the oblong matrix, a guide, and a counter perfectly aligned to make the respective perforation.

DETAILED DESCRIPTION OF THE INVENTION

Figure 1:
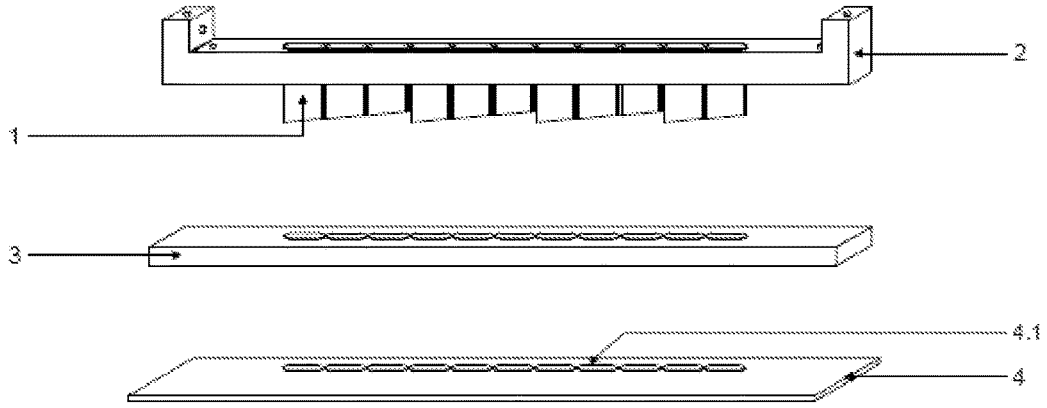
FIG. 1 is a side exploded view of the subsystem of oblong matrix including three calibrated platforms provided with integrated calibrated mechanical support, perforation, and binding devices of the present invention.

The present invention is described based on a preferred modality in which is to be understood that the invention is not limited in its application to the construction details and the arrangement of the components specified in the presentation of reception or illustrated in the drawings.

It is mentioned, unless otherwise specified, that all of the scientific or technical terms used in this document have the same meaning that people with knowledge of the arts commonly have of the invention. The methods and examples provided in this document are illustrative and not intended to be a limitation.

With reference to FIG. 1, the universal perforation system of the present invention, includes a first subsystem of oblong matrix (carrying a perforation selector mechanism not shown in this figure) is a device that includes three platforms (2), (3) and (4), whose dimensions, relative space layout, and dynamic articulation among themselves and with other components, allows it to operate, being able to connect in oblong perforations and thus replace the multiple number of perforations that each perforation pitch currently required by each perforation and binding systems; perforations produced altogether aligned stacked sheets which are able to connect in oblong perforations and thus replace the multiple number of perforations that each currently perforation step requires with each perforation and binding system; it is the first subsystem that is installed and connects a second subsystem represented by any machine of the plurality of existing machines used in perforation and binding systems, as well as of the different sizes and binding formats in use.

In addition, in FIG. 1, the oblong matrix (which carries a perforation selector mechanism, not shown in this figure) includes three elongated rectangular platforms: a first platform (2) male punches holder (1) male, a second platform (3) of the same dimensions as the first platform that serves as a punch guide, and a third support platform (4) of greater dimensions than the previous ones having a row of female punches (4-1) having oblong configuration, that made the perforations on the paper (not shown) altogether coincidentally aligned with the male punches (1), when the subsystem is operating in the closed position.

Figure 2:
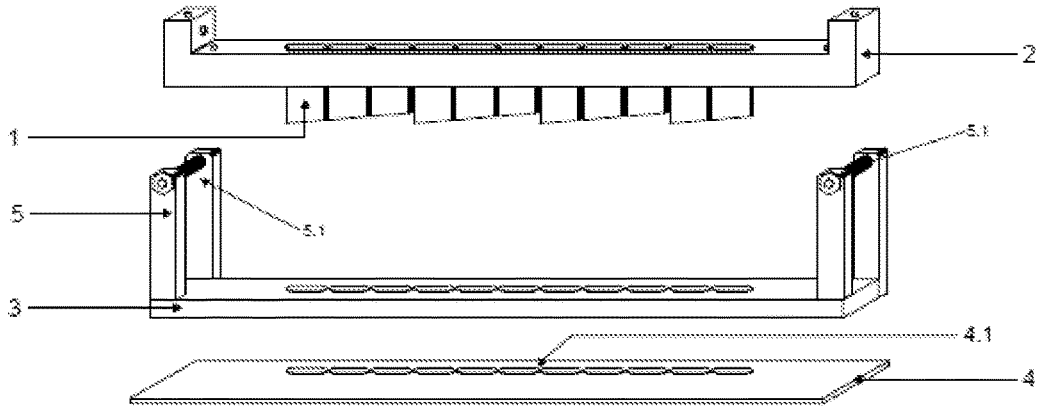
FIG. 2 is an exploded view of the subsystem of oblong matrix including three calibrated platforms showing connection clamping bars between the punches holder bars, punch guide bar, and the blade bar for perforation.

Referring to FIG. 2, the oblong matrix (which carries a perforation selector mechanism, not shown in this figure) includes three elongated rectangular platforms: a first platform or bar (2), male punches holder (1), a second platform, or bar (3) of equal size as the first platform that serves as a punches guide and a third platform or support bar (4) of bigger dimensions than the previous ones in which provided a row of female punches (4-1) having oblong configuration, the set of male punches, punches guide, and female punches perfectly aligned and calibrated to do the perforations in the paper (not shown).

The bars or platforms (2) and (3) are connected via four connecting fastening vertical bars (5) mounted by their lower ends in the vertex of the platform (3), while their upper edges are shaped in the form of frames by two pairs of bars (5) connected by means of two screws (5-1) respectively, and placed parallel on the small sides of the guide platform (3).

Now in reference to FIG. 2A, shows in top floor of all three platforms (2), (3) and (4) horizontally shifted and perfectly aligned to make the respective perforation. The spaces (X) that form between each of one of the above-indicated perforations, have integrated equidistant distances metrologically controlled to the three platforms (2), (3) and (4), that allow that at the moment of placing the double loop wire, the coil of any pitch, either plastic or metallic, and the plastic combs (not shown) or when introducing the sheets on the platforms 2, 3, 4, or multiple rings binders (not shown) when required, to easily enter and an optimal binding result. Likewise, the established correlations allow to scale the symmetry in the space disposition of the produced oblong perforations, in accordance with the various measures of the sheets of paper to be perforated.

In addition, in FIG. 2A, for example, is then given a preferred embodiment (not only) of this essential part or subsystem that can be articulated or mounted on an existing binding machine (not shown) and it should be emphasized that this spiral binding machine of the system of the present invention, can be mounted on any machine (not shown) of the type known to this purpose, for which must understand as a component part of the perforation system of the present invention and that includes existing mentioned devices, as well as the oblong perforation form (4-2) produced. The row of female punches (4-1), having oblong configuration, which performs the paper perforation (not shown) along with the male punches (1) when the subsystem is operating in the closed position.

Furthermore, regarding FIG. 2A, the platform (2) is about 38.5 cm long, about 4 cm wide, and about 3 mm thick; platform (3) has the same previous measures; and platform (4) has about 48 cm long, about 5 cm wide, and about 3.5 cm thick; the punches (1) (not shown) have a height of about 3.2 cm, about 4.75 mm wide, and about 22.5 long. The comb (2) and the guide (3) are manufactured of slab steel (cold rolled) or any other steel and the counter (4) is made of hardened steel or any other type. The holes (4-3) of the lower platform (4) are countersink for grub screws.

In addition, regarding FIG. 2A, the system of the present invention as a whole, produces oblong perforations (4-2) through the oblong punches (1) that are a feature of the present invention and not only the assembly and the mounting of the subsystem of platforms (2), (3) and (4) aligned and calibrated, on an existing new or conventional machine; advantageously may be used on an electric perforation binding machine as the known or as yet unknown, provided they incorporate the characteristic oblong punches (1) needed to produce oblong perforations (4-2), able to include all of the sheet perforation steps in a single set of oblong perforations (4-2), features also the concept of the system of the present invention.

Figure 3:
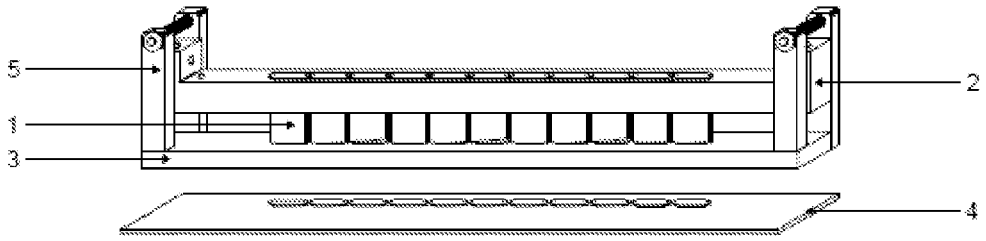
FIG. 3 is a side view of the subsystem of the oblong matrix showing the form of assembly between the clamping bars, the punches holder bars, the punches guide bar, and the blade bar for perforation, mounted in the guide and with the oblong blades, in which the subsystem is in the open position.

Referring to FIG. 3, the subsystem of the oblong matrix (which carries a perforation selector mechanism, not shown in this figure) showing the assemble between the four connecting fastening vertical bars (5) that operates the punches holder platforms or bars (2), and the punches guide bar (3), being both platforms or bars (2) and (3) vertically separated, in open position, while the platform or bar (4) with the female perforation blade, and the oblong perforation blade (4-1), stays in fixed position on the surface of the binding machine or second subsystem (not shown).

Figure 4:
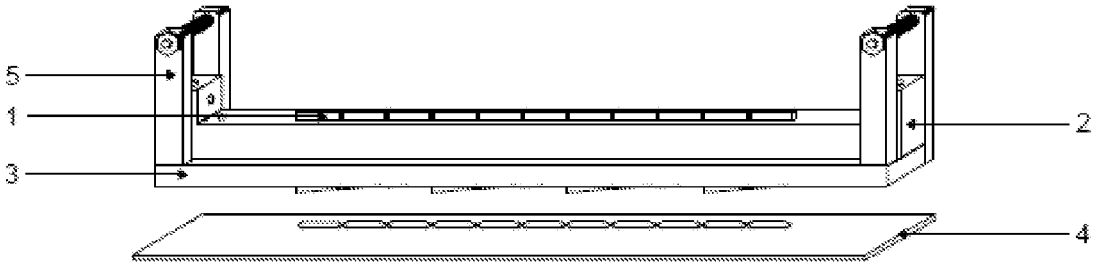
FIG. 4 is a side view of the subsystem of the oblong matrix showing how to assemble between clamping bars between the bars, the punch holder bars, the punch guide bar, and the blade bar for perforation, mounted in the guide and with the oblong blades, in which the subsystem is in the closed position.

Now referring to FIG. 4, the subsystem of the oblong matrix (which carries a perforations selector mechanism, not shown in this figure) showing how to assemble between the four connecting fastening bars (5) that operate the platforms or punches holder bar (2), and the punches guide bar (3), while both platforms (2) and (3) are in contact, when the first subsystem of the present invention is in closed position, while the platform or female perforation blade bar (4), and with oblong female perforation blades (4-1), stays in fixed position on the surface of the binding machine or second subsystem (not shown).

Figure 5:
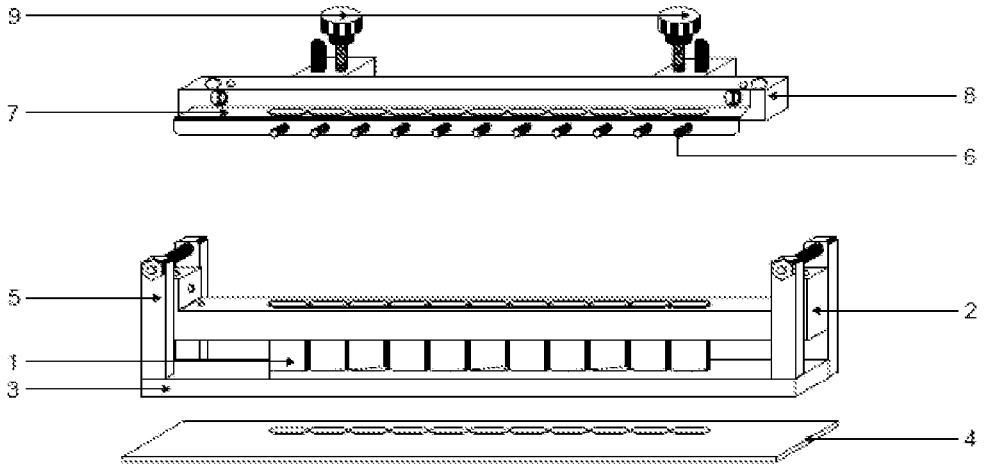
FIG. 5 is a side view of the subsystem of oblong matrix showing the perforation selector mechanism.

FIG. 5 shows, in the open position, the first subsystem of oblong matrix of the present invention, and in its upper section, the perforation selector mechanism, main purpose of the improvement, same which is integrated by the perforation selectors (6); the perforation selectors holder bar (7); the selector holder bracket (8) and support device for closing the double loop wires; and the screws (9) leveling of the closing bar.

The formation of equidistant spaces throughout the oblong holes (not shown) produced in sheets of different sizes and in different binding formats, is obtained with the help of the synchronized connection and alignment of a perforation pattern selector mechanism (6), which applied synchronous proportional position perforation patterns, according to the dimensions and formats of sheets and the binding and that allows to block or selectively open the perforation positions to apply different binding formats.

Figure 6:
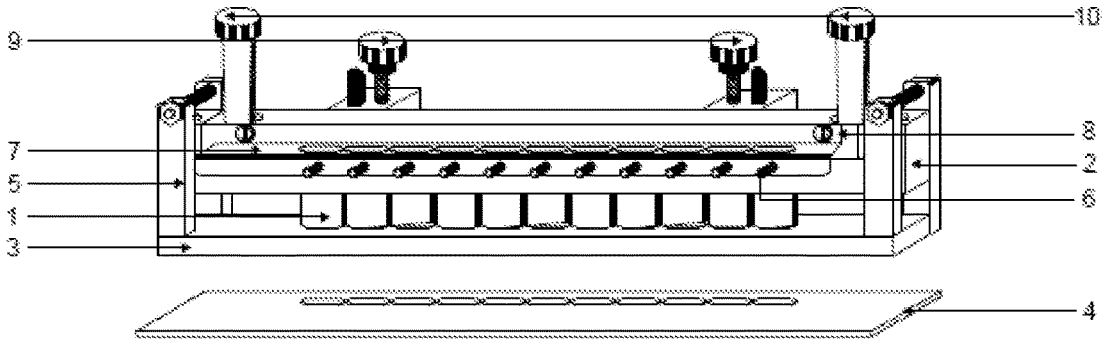
FIG. 6 is a rear view of the subsystem of oblong matrix showing the assembly way for placement on any binding machine of any of the existing binding systems.

FIG. 6 shows the first subsystem showing the way in which assemble for placement on any spiral binding machine of any of the existing binding, by using handles (10) that connect and secure the entire universal perforation system of the present invention into a single operational unit steps.

Figure 7:
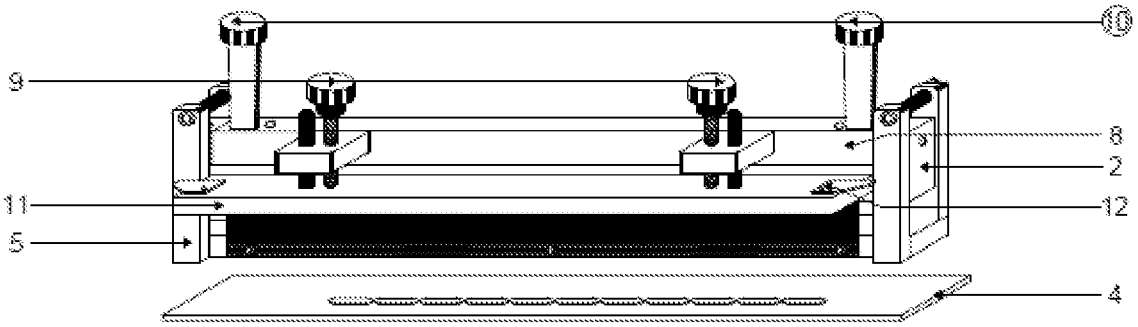
FIG. 7 is a front view of the subsystem of oblong matrix showing the loop wire locking bar and the leveling handles.

Now referring to FIG. 7, it shows the loop wire locking bar (11) and the leveling handles it, as well as level indicating arrows (12) for the closing bar which ensure a uniform operation during the closing of the loop wires.

Figure 8:
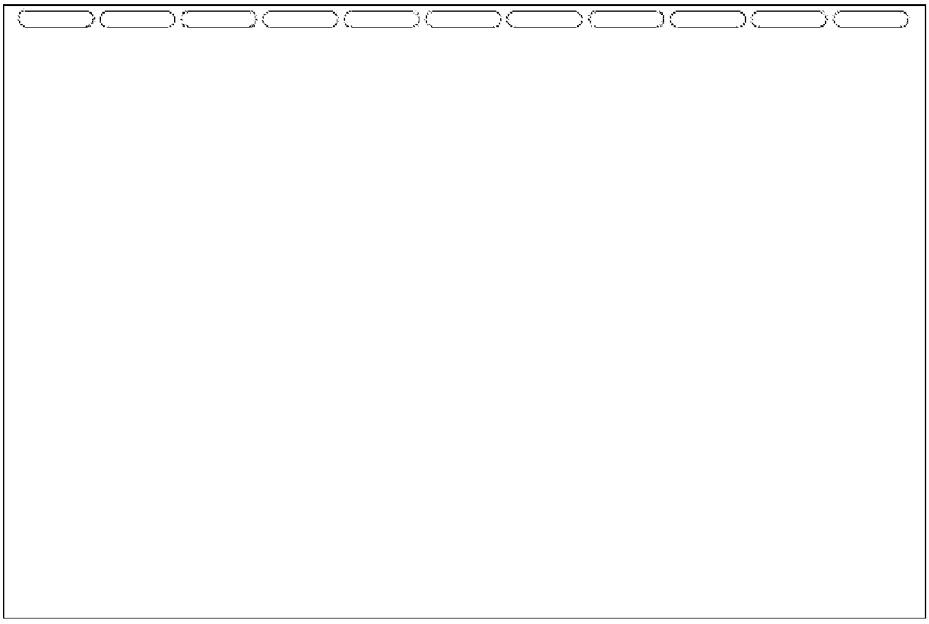
FIG. 8 shows the figure of a binding sheet showing the actual size of the perforated and noting the perforated positions that may be used for longer sheets by sliding or extending the mechanism in long or short assemblies of legal size, A4 size, A3 size, A2 size, etc.

With reference to FIG. 8, it shows the actual size of the perforated paper sheets, showing at the same time the perforation positions, and demonstrating the possibility that the first subsystem of the present invention that carries the perforations selector mechanism, may be used to perforate longer papers, by sliding or extending the mechanism in long or short assemblies of legal size, A4 size, A3 size, A2 size, etc., using jointly the perforation selector mechanism (6), so the versatility, the universality, and the industrial system of the present invention used can be checked.

Figure 9:
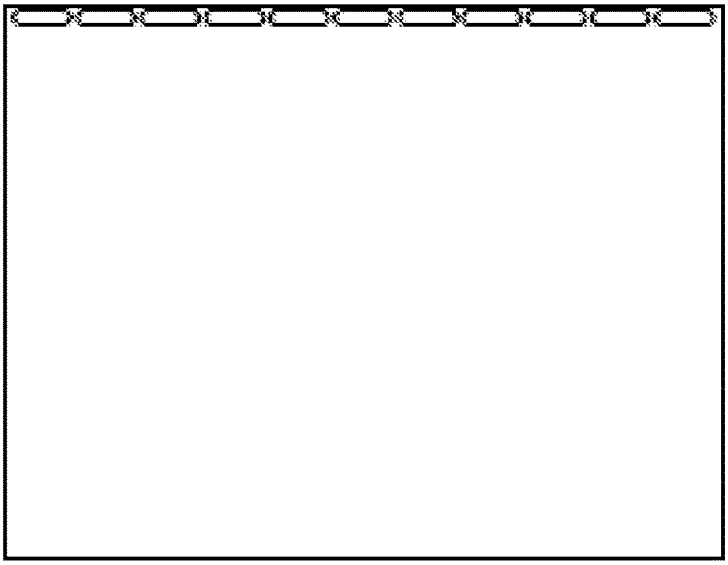
FIG. 9 shows the figure of a sheet that indicates how the 11 oblong perforations are placed in the binding sheets, at the edge of the letter size sheets.

Finally, in reference to FIG. 9, it shows a sheet of paper that indicates how the 11 oblong perforations are placed in the binding sheets, at the edge of the letter size sheets.

It will be evident to those skilled in the art, which can be made innumerable modifications to the present invention without deviating from the spirit and scope of the same, so this should be considered in its broadest sense and not restrictive.

NOVELTY OF THE INVENTION

Having thus described the invention, it is considered as novel and, therefore, is claimed to property contained in the following claims.

The invention claimed is:

1. An improved perforation system adapted to be installed on a binding machine or a spiral binding machine, the system comprising:

an oblong matrix, the matrix including a perforation selector mechanism;

a first platform;

a second platform, a third platform, the first platform includes a set of male punches;

the second platform includes a punches guide;

the third platform includes a row of female punches each having an oblong shape;

the set of male punches, the punches guide, and the row female punches are all aligned to produce perforations in a paper when installed on the binding machine or the spiral binding machine;

the perforations each having an oblong shape;

wherein the first platform and the second platform are connected via vertical bars, each vertical bar is placed on a corner of the second platform, each vertical bar has a lower end mounted on the corresponding corner of the second platform and an upper end, the upper ends of adjacent vertical bars are connected by using a fastener.

2. The system of claim 1, wherein the row of female punches perform the paper perforation along with the set of male punches when the oblong matrix is operating in a closed position.

3. The system of claim 1, wherein the third platform is secured to a surface of the binding or spiral binding machine.

4. The system of claim 1, wherein the perforation selector mechanism includes perforation selectors, a perforation selectors holder bar, a perforation selector holder bracket, a support device for closing double loop wires, and screws for leveling the support device.

* * * * *